United States Patent [19]

Blanquet

[11] 4,062,071

[45] Dec. 13, 1977

[54] CLOSET SEAT FITTED WITH A VALVE CONTROLLED DOUCHE

[75] Inventor: Georg V. Blanquet, Baden-Baden, Germany

[73] Assignee: Gaggenau- Werke, Haus- und Lufttechnik GmbH, Gaggenau, Germany

[21] Appl. No.: 693,924

[22] Filed: June 7, 1976

[30] Foreign Application Priority Data

June 14, 1975 Germany ..... 2526736

[51] Int. Cl.[2] ..... E03D 9/08; F24H 1/18

[52] U.S. Cl. ..... 4/7; 219/306; 219/314

[58] Field of Search ..... 4/6, 7, 179; 126/360; 165/40; 219/306, 314

[56] References Cited

U.S. PATENT DOCUMENTS

| | | | |
|---|---|---|---|
| 1,680,014 | 8/1928 | Dale et al. | 219/314 |
| 2,779,855 | 1/1957 | Sawyer | 219/306 X |
| 3,154,793 | 11/1964 | Congdon | 4/7 |
| 3,247,524 | 4/1966 | Umann | 219/306 X |
| 3,594,826 | 7/1971 | Maurer | 4/7 |
| 3,810,260 | 5/1974 | Lodi | 4/7 |

*Primary Examiner*—Richard E. Aegerter
*Assistant Examiner*—Stuart S. Levy
*Attorney, Agent, or Firm*—Wenderoth, Lind & Ponack

[57] ABSTRACT

A water closet seat is fitted with a valve controlled douche. An electric heater warms the water for the douche and a heater chamber provides a small quantity of water at a thermostatically controlled temperature for storage in a reservoir. The reservoir is arranged in conjunction with the heater chamber so as to allow directly heated water to supplement the stored water on operation in such a way as to ensure an even water temperature.

4 Claims, 2 Drawing Figures

CLOSET SEAT FITTED WITH A VALVE CONTROLLED DOUCHE

BACKGROUND OF THE INVENTION

The invention relates to a closet seat fitted with a valve-controlled douche having underneath the rear end of the seat, one or more spray heads supplied with warm water.

A closet seat fitted with a valve-controlled douche is known, wherein around the edge of the seat there are provided a number of spray heads supplied with warm water. For heating the water a single pass heater in the form of a long tubular plastics water jacket is provided inside the seat itself and extends around the curved forward end of the seat near the edge thereof. An immersion heater is located inside the water jacket. The temperature of the water, which is heated only during use, can be varied by adjustment of a needle valve which regulates the rate of flow through the water heater and hence the water exit temperature.

In this and in several other known closet seats fitted with a douche difficulties arise in connection with the supply of the spray head or heads with warm water at a temperature which can be kept constant. The usual electric heaters have an irregular heating effect on the water, particularly if they function as once-through heaters and operate only for short periods of time.

SUMMARY OF THE INVENTION

The present invention contemplates the problem of providing a closet seat fitted with a valve-controlled douche in which substantially uniformly heated water is supplied to the spray head or heads for different periods of use even though a relatively small amount of water is stored.

According to the invention there is provided a water closet seat fitted with a valve-controlled douche positioned in a hollow rearward extension integrally connected to the rear end of the seat. At least one spray head is fitted to the seat underneath the rear end thereof. A heater including a reservoir chamber is contained within the rearward extension to heat for water to be supplied to the spray head. A heater chamber is positioned within the reservoir chamber. A thermostatically controlled heater is contained within the heater chamber for heating the water. A duct connects the reservoir chamber and the spray head through which duct the water can be supplied to the spray head. In operation, a store of warm water is kept in the reservoir chamber and by the provision of appropriate lagging, for instance by enveloping the reservoir chamber with plastics, satisfactory thermal insulation of the reservoir chamber can be achieved. When the douche is operated the or each spray head is first supplied with warm water which is drawn from the reservoir chamber where it has been kept warm by the thermostatically controlled heater, a like amount of water simultaneously entering the reservoir chamber from the heater chamber. The water heater which also functions as a single pass heater may be thermostatically controlled by means of a temperature sensor. Since the direct supply of water heated in the heater chamber might well lead to undesirable temperature fluctuations, the heated water is first transferred from the heater chamber into the reservoir chamber wherein its direction of flow may be reversed. If the heater chamber and the reservoir chamber together comprise of a unitary assembly it will be particularly useful to arrange for the cold water to flow throgh the heater chamber in a direction countercurrent to the direction of warm water flowing out of the reservoir chamber. A countercurrent arrangement of this kind can reduce extremes of temperature and thereby improve the uniformity of the water outlet temperature. With a view to ensuring a highly efficient heating effect it is desirable for the heater chamber to consist of the interior of a length of tubing which contains an electric heater element and the temperature sensor. The reservoir chamber embraces this length of tubing and there is communication provided between the heater chamber and the reservoir chamber at only one end of the tubing. Conveniently the cylindrical inner heater chamber and the hollow cylindrical outer reservoir chamber are coaxially arranged, the water being conducted in counterflow to ensure a substantially uniform water outlet temperature even when the heater wattage is high.

The electric heater element of the equipment may with advantage be a cylindrically helically coiled element and the entry of the cold water may be situated near the axis of symmetry of the cylindrical helical coil. This provides a favourable pattern of flow of the cold water in relation to the cylindrical heating element and the inner wall of the length of tubing which divides the heater chamber from the reservoir chamber. By making the length of tubing of a thermally highly conductive metal there will be a supplementary direct transfer of heat into the reservoir chamber which in conjunction with the thermostatic control of the heater helps to keep the water outlet temperature uniform and to make the thermostatic control system more responsive.

In a useful development of the invention the reservoir chamber may have an outlet for supplying the or each spray head, which outlet is positioned at a low level, where the water temperature will be lowest. This also helps to guard against undesirable temperature variations.

Moreover, in the context of countercurrent flow of the water through the heating equipment the warm water outlet of the reservoir chamber should be situated at the same end of the length of tubing as the entry of the cold water into the heated chamber.

Further design advantages can be secured by locating the essential parts of the heating equipment inside an installation cylinder which is exchangeably accommodated inside the hollow rear extension of the closet seat. Such a design, which has already been disclosed for other assemblies associated with closet seats, such as air extractors and the like, offers advantages both from the production and from the maintenance points of view. Instead of making use of an installation cylinder, other ways within the skill of a craftsman of combining the several indivdual components in an exchangeable assembly might also be considered.

According to another feature of the invention it may be desirable to incorporate in the connecting duct between the warm water outlet and the spray head or heads a safety element which is designed to prevent back flow of water from the or each spray head into the reservoir chamber and hence possibly through the open control valve into the fresh water supply mains. Such a safety element is necessary to eliminate every possibility of the mains supply being contaminated with pathogenic germs. In the absence of such a return flow safety element, if the or each spray head happened to be wetted by dirty water it might be possible under some circumstances for unhygienic matter to enter the mains.

Preferably the safety element may take the form of a non-return valve which prevents a suction pressure from being transmitted to the or each spray head.

The features of the present invention provide a closet seat fitted with a valve-controlled douche in which the heated water is delivered at a substantially uniform temperature, although little water is actually stored. Moreover, the preferably axially symmetrical overall design is simple and economical to produce, and particularly when assembled inside an installation cylinder the equipment can be readily accommodated inside the rear extension of the closet seat.

BRIEF DESCRIPTION OF THE DRAWINGS

The invention will further be described with reference to the accompanying drawings of which.

DETAILED DESCRIPTION OF THE INVENTION

Figure 1:
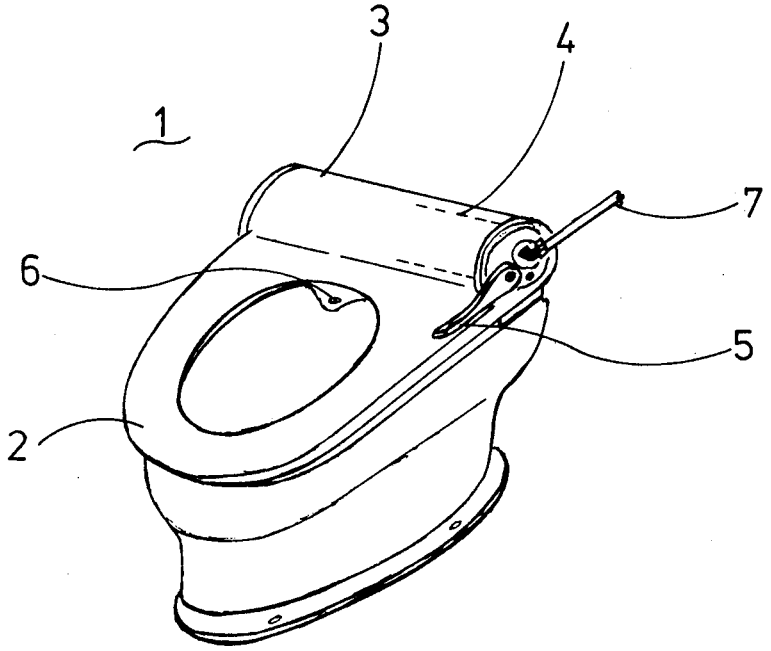
FIG. 1 is a perspective view of a closet seat fitted with a valve-controlled douche according to the invention.

Referring to FIG. 1 there is provided a closet top fitting 1 comprising a closet seat 2 and integrally connected to the rear end of the seat a hollow rear extension 3 into which a installation cylinder 4 is slidably insertable, the cylinder containing parts of a water heater and associated valve and control means. The control valve is operable by a handle 5 which controls the admission of water to a spray head 6 fitted to the underside of the rear end of the seat. Water is supplied through a pipe 7.

Figure 2:
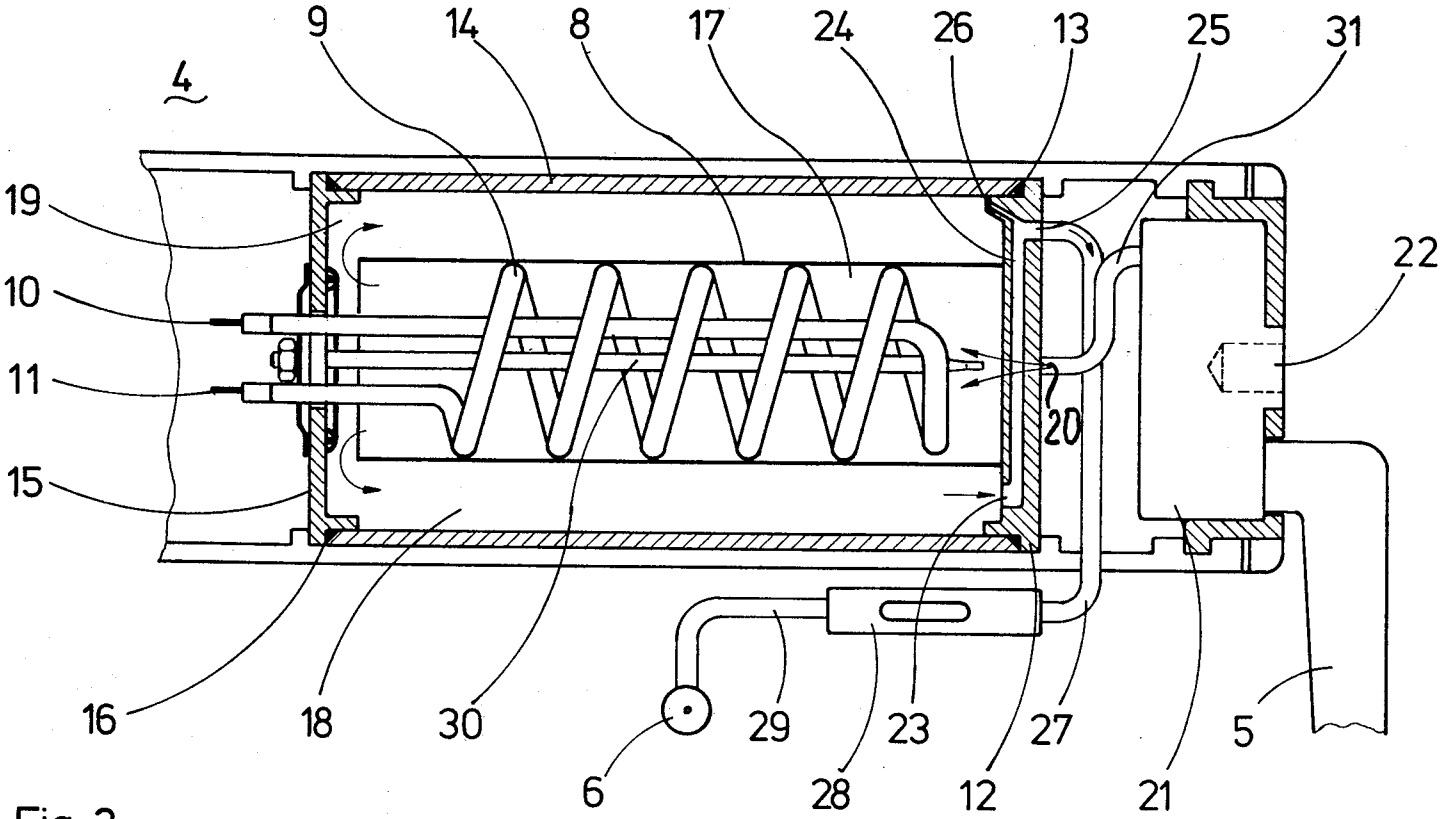
FIG. 2 is a section through an installation cylinder containing heating equipment according to the invention.

Particulars of the construction of the water heater will be understood from FIG. 2 which is an axial section through the installation cylinder 4. The cylinder 4 contains a length of metal tubing 8 of which the internal walls are in intimate metallic and heat conducting contact with a helical heater element 9. The ends 10 and 11 of the heater element 9 are connected in conventional manner to an electric supply via leads. The piece of tubing 8 is attached at one end thereof to a flange 12 which with the interposition of a cord type sealing ring 13 is fitted into an outer tubular jacket 14 of insulating plastics material. The other end of the tubular jacket is closed by a cover plate 15 which likewise fits into the end of the jacket 14 with the interposition of a peripheral seal 16. The interior of the length of tubing 8 forms a heater chamber 17, and the space between the length of tubing and the outer tubular jacket forms an annular reservior chamber 18. Communication between the two chambers 17, 18 is provided only at the end of the tubing by a passage 19 bordered by the cover plate 15.

A cold water inlet 20 is provided in the flange 12 coaxial with the heater element 9. For the admission of cold water a cold water connection 31 leads from a control valve 21 which is only schematically shown in the drawing. This control valve 21 responds to the operation of a handle 5 to admit water to the heater equipment and thence through an intermediate duct 27 to the spray head 6. The cold water connection of valve 21 is formed by a sleeve 22 provided with internal screw threads.

In a low-level portion of the reservoir chamber 18 there is a heated water outlet 23 through which the heated water that is to be discharged from the spray head 6 enters a raiser 24 which is a blind hole provided with a screw plug and ends at a warm water outlet connection 25. At the top of the riser from where the water enter the outlet connection 25 there is an air vent 26, within which a spring-loaded venting valve could be fitted, if desired.

The warm water connection 25 is connected by the duct 27 which includes a schematically shown non-return valve 28 whence the water is taken through a pipe 29 to the spray head 6. The spray head is preferably of the eyeball type which can be adjusted to spray in any desired direction.

The installation cylinder 4 may, if desired, contain additional components, for instance for the generation of hot air for a hot air dryer and/or for ventilation.

The tubular heater 9 is switched on by a temperature sensor 30 projecting into the heater chamber 17 so that during operation warm water continues to be available. With advantage the heater equipment may have two power stages. The first low power stage can then be used for continuously reheating the stored water, whereas the second additional state is activated only when the douche has been used and cold water from the cold water supply 20 re-enters the heater chamber 17. The activation of the additional heating stage is controlled by a special tempeature sensor or conveniently by associating a trip with the control valve.

It has been found that it is desirable for the capacity of the reservoir 18 to be greater than, more preferably 1.5 times greater than, the capacity of the heater chamber 17. In a useful form of construction the capacity of the reservoir 18 may be 0.45 liters and that of the heater chamber 17 0.3 liters.

I claim:

1. A device including a water closet seat having a rear end and being fitted with a valve controlled douche, said device comprising:

- a hollow rearward extension integrally connected to the rear end of the seat;
- at least one spray head fitted to the seat beneath said rear end thereof;
- a heater chamber contained within said hollow rearward extension of the seat;
- a length of metallic tubing contained within said hollow rearward estension of the seat and defining on the inside thereof said heater chamber;
- a flange closing one axial end of said length of metallic tubing;
- a cold water inlet extending through said flange axially of said length of metallic tubing;
- a cylindrically helically coiled electric heater element contained within said length of metallic tubing in intimate contact therewith;
- a thermostatic sensor for controlling said cylindrically helically coiled electric heating element to heat water in said heater chamber, said thermostatic sensor being contained within said heater chamber;
- a reservoir chamber contained within said hollow rearward extension of the seat and surrounding said heater chamber, the capacity of said reservoir chamber being greater than the capacity of said heater chamber;
- a communication passage for water to pass from said heater chamber to said reservoir chamber, said communication passage being disposed at the end of said length of metallic tubing opposite to said flange;

a reservoir jacket of thermally insulating plastics material contained within said hollow rearward extension of the seat and defining on the inside thereof said reservoir chamber, said reservoir jacket being in sealing contact with said flange;

a cover plate closing the end of said reservoir jacket at the end thereof opposite said flange;

a heated water outlet from said reservoir chamber positioned at a low level in said flange, cold water entering said heater chamber from said cold water inlet flowing in a direction countercurrent to the direction of flow of heated water which leaves said reservoir chamber from said heater water outlet, the heated water leaving said reservoir chamber leaving from a point therein whereat the water temperature is lowest;

a riser extending from said heated water outlet through said flange;

an air vent in said riser;

an outlet duct extending from said riser to said spray head for conveying heated water to said spray head; and a non-return valve disposed in said outlet duct.

2. A device as claimed in claim 1, further comprising an installation cylinder which is exchangeably accommodated within said hollow rearward extension of the seat, said reservoir jacket being accommodated within said cylinder.

3. A device as claimed in claim 2, wherein said cylindrically helically coiled electric heater element comprises a two stage cylindrically helically coiled electric heater element.

4. A device as claimed in claim 1, wherein the capacity of said reservoir chamber is 1.5 times the capacity of said heater chamber.

* * * * *